US006231486B1

(12) United States Patent
Lee

(10) Patent No.: US 6,231,486 B1
(45) Date of Patent: May 15, 2001

(54) FULL-FUNCTIONAL WEIGHT TRAINING GYM

(76) Inventor: Hsiao-Chung Lee, No. 82, Man-Ping Street, Pan-Chiao City, Taipei County (TW)

( * ) Notice: Subject to any disclaimer, the term of this patent is extended or adjusted under 35 U.S.C. 154(b) by 0 days.

(21) Appl. No.: 09/593,241

(22) Filed: Jun. 14, 2000

(51) Int. Cl.[7] ..... A63B 21/062

(52) U.S. Cl. ..... 482/101; 482/102; 482/135; 482/139

(58) Field of Search ..... 482/94, 98, 99, 482/101–103, 133, 135, 138, 139; D21/673, 675, 676

(56) References Cited

U.S. PATENT DOCUMENTS 4,195,834 * 4/1980 Lambert ..... 482/101
4,346,888 * 8/1982 Szabo ..... 482/98

OTHER PUBLICATIONS

Body Solid Catalog pp. 21–27, 1993.*

* cited by examiner

*Primary Examiner*—John Mulcahy
(74) *Attorney, Agent, or Firm*—Dougherty & Troxell

(57) ABSTRACT

The invention provides a full functional weight training gym, and in particular, one that is constructed essentially by supporting a main skeleton on a supporting base with nuts and bolts, and hanging and snapping a sliding backrest with a rope hanging cord loop to drive a pulley block and hence to pull a weights set in a up and down motion. A gym that can be used for weight training on legs with a proper pose is thus obtained. In addition, by combining a set of fittings, including a two-handed long pulling bar, a two-handed short pulling bar, a single-handed short pulling bar, a single-handed ring-shaped pulling bar, a two-handed rope-type pulling bar, a leg band-type pulling ring, a back and forth adjustable plate chair, a foot pressing bar, and a quick snap loop, weight training on all parts of the body involving hands, the chest, the abdominal, the waist, the bottom, the back and shoulders, can be accomplished by only one gym and a less space.

12 Claims, 8 Drawing Sheets

FULL-FUNCTIONAL WEIGHT TRAINING GYM

BACKGROUND OF THE INVENTION

1. Field of the Invention

The invention relates to a full-functional weight training gym, and in particular to a full-functional gym, wherein by adjusting a sliding backrest in a natural manner, a proper pose can be established during weight training on legs, and by assembling a single set of gym and accompanied fittings, muscles at other parts of the body can be trained as well.

2. Description of the Prior Art

Earlier weight training gym, as shown in FIG. 1, takes advantage of the principle of loading weight by putting a barbell 11 on the shoulder and then standing up and squatting down to train the muscle of legs. Since there is no safety faculty during this training, in case of overloading, the person might be pressed and hurt by the barbell 11, or in case of operating in an improper pose, the waist, the spinal cord, and the knee 13 are prone to be hurt. Therefore, a waistband 12 should be tied up to ensure the safety.

Accordingly, the recent conventional weight training gym accomplishes training on leg muscle even in conjunction with a mechanism as a weightlifting machine 2. Among them, the notable one is the so-called 'the Smith's weight training gym', as shown in FIG. 2, wherein, two parallel steel pipes 21 are provided on both sides thereof, and are secured to both ends of a barbell 23 by a bearing sleeve 22 such that the barbell 23 can slide up and down together with those two parallel steel pipes 21. Further, a plurality of hanging bars 24 are provided on two vertical supports to correspond with hanging hooks on the bearing sleeve 22. With this configuration, in case of rapid falling of the barbell 23, the barbell 23 can be stopped instantaneously by hanging and snapping on the hanging bar 24 by the hanging hook 25 to avoid hurting men. Therefore, one can feel safe, and places himself at the center of two supports, ties up the waist band 26, loads the barbell 23 on his shoulders, and stands up and squats down to achieve the object of weight training on legs. However, due to varying degree of the training of persons, the wrong squatting pose during operating, and the like, damages on the waist, the spinal cord and the knee 13 often occurr even though a waist band 26 is tied up. This is derived from the abnormal press caused by the bending of the spinal cord due to the wrong squatting pose. A right squatting pose is in a manner of sitting such that the spinal cord is subjected to a vertical force and hence no pressure on the waist is present. As a result, there can be no danger even no waistband is tied up on the waist.

In view of the foregoing, the above-described conventional weight-training machine has still many disadvantages and is not a perfect design that needs to be improved eagerly. Accordingly, it is desirable to design a novel weight training gym that, during weight training on legs, can help adjusting the squatting pose into a correct sitting manner by means of its mechanistic structure. In addition, it changes the original way of loading the barbell on shoulders into a manner of pulling weights by hand, so that the direct heavy force pressing on the waist, the spinal cord and the knee can be eliminated completely. As a result, the exercise damages on the waist, the spinal cord and the knee can be avoided and the weight training on legs can be more safely done.

Furthermore, through the variation of mechanistic structure, if the mechanism of hanging and pulling weights by a pulley can be used in combination with a variety of pulling bar and fittings, a number of weight training gyms can be assembled to achieve an effect of accomplishing the weight training on all parts of the body by a single mechanistic structure.

In view of the above-mentioned disadvantages associated with the conventional weight training gym, the inventor aims to improve and invent, and, after carrying out an intensive study and many experiments, the full functional weight training gym according to the invention is successfully developed.

SUMMARY OF THE INVENTION

One object of the invention is to provide a fill functional weight training gym that, by means of a sliding backrest, a right pose during weight training on legs can be adjusted and the purpose of training the legs can be safely achieved with no necessity to tie up a waistband.

Another object of the invention is to provide a full functional weight training gym such that, for common users, the weight training on all other parts of the body can be achieved by only one single gym and in a less space.

The full functional weight training gym that can fulfill the above-described objects according to the invention comprises a constitutive structure consisting of a supporting base, a main skeleton, a sliding backrest, a weights set, a pulley block, and a set of fittings. The full functional weight training gym is constructed essentially by supporting said main skeleton on said supporting base via nuts and bolts, and hanging and snapping said sliding backrest with a rope hanging cord loop to drive said pulley block and hence pull said weights set in a up and down motion. A gym that can be used for weight training on legs with a proper pose is thus obtained. In addition, by combining said set of fittings and said pulley block as well as said weights set, a variety of weight training gym can be assembled for performing exercises involving hands, the chest, the abdominal, the waist the bottom, the back and shoulders, and hence accomplishing weight training on all parts of the body by only one mechanistic structure.

BRIEF DESCRIPTION OF THE DRAWINGS

The drawings disclose an illustrative embodiment of the present invention, which serves to exemplify the various advantages and objects hereof, and are as follows.

[Representative symbols for main elements]:

| | |
|---|---|
| 11 | barbell |
| 12 | waistband (belt) |
| 13 | knee |
| 2 | weightlifting machine |
| 21 | steel pipe |
| 22 | bearing sleeve |
| 23 | barbell |
| 24 | hanging bar |
| 25 | hanging hook |
| 26 | waistband |
| 31 | supporting base |
| 321 | inverted V-shaped |
| 322 | crossbar parallel connecting rail |
| 323 | lower crossbar |
| 33 | sliding backrest |
| 331 | back pad |
| 332 | frame |
| 333 | bearing |
| 334 | steel pipe |
| 335 | spring |
| 336 | parallel handles |
| 34 | weights set |
| 341 | weight |
| 342 | steel pipe |
| 343 | pin bar |
| 344 | weight hanging bar |
| 345 | running block |
| 346 | rope |
| 3461 | upper cord loop |
| 3462 | buffering bead |
| 3463 | lower cord loop |
| 3464 | buffering bead |
| 35 | pulley block |
| 351 | upper semi-standing block |
| 352 | upper front standing block |
| 353 | upper rear standing block |
| 354 | lower rear standing block |
| 355 | lower semi-standing block |
| 36 | fittings |
| 361 | two-handed long pulling bar |
| 3611 | long steel bar |
| 3612 | handle grip sleeve |
| 3613 | rope cord loop |
| 362 | two-handed short pulling bar |
| 3621 | short steel bar |
| 3622 | handle grip sleeve |
| 3623 | rope cord loop |
| 363 | single-handed short pulling bar |
| 3631 | short steel pipe |
| 3632 | cord loop |
| 364 | single-handed ring-shaped pulling bar |
| 3641 | steel pipe |
| 3642 | U-shaped ring |
| 3643 | Rope cord loop |
| 365 | Two-handed rope-type pulling bar |
| 3651 | Coarse rope |
| 3652 | Rope cord loop |
| 366 | Leg band-type pulling ring |
| 3661 | Velcro tape |
| 3662 | Cloth |
| 3663 | Rope cord loop |
| 367 | Back and forth adjustable plate chair |
| 3671 | Front section plate chair |
| 3672 | Rear section plate chair |
| 3673 | T-shaped included angle support |
| 3674 | Adjusting step seat |
| 368 | Foot pressing bar |
| 3681 | Adjusting hole |
| 369 | Quick snap loop |

DETAILED DESCRIPTION OF THE PREFERRED EMBODIMENT

Figure 1:
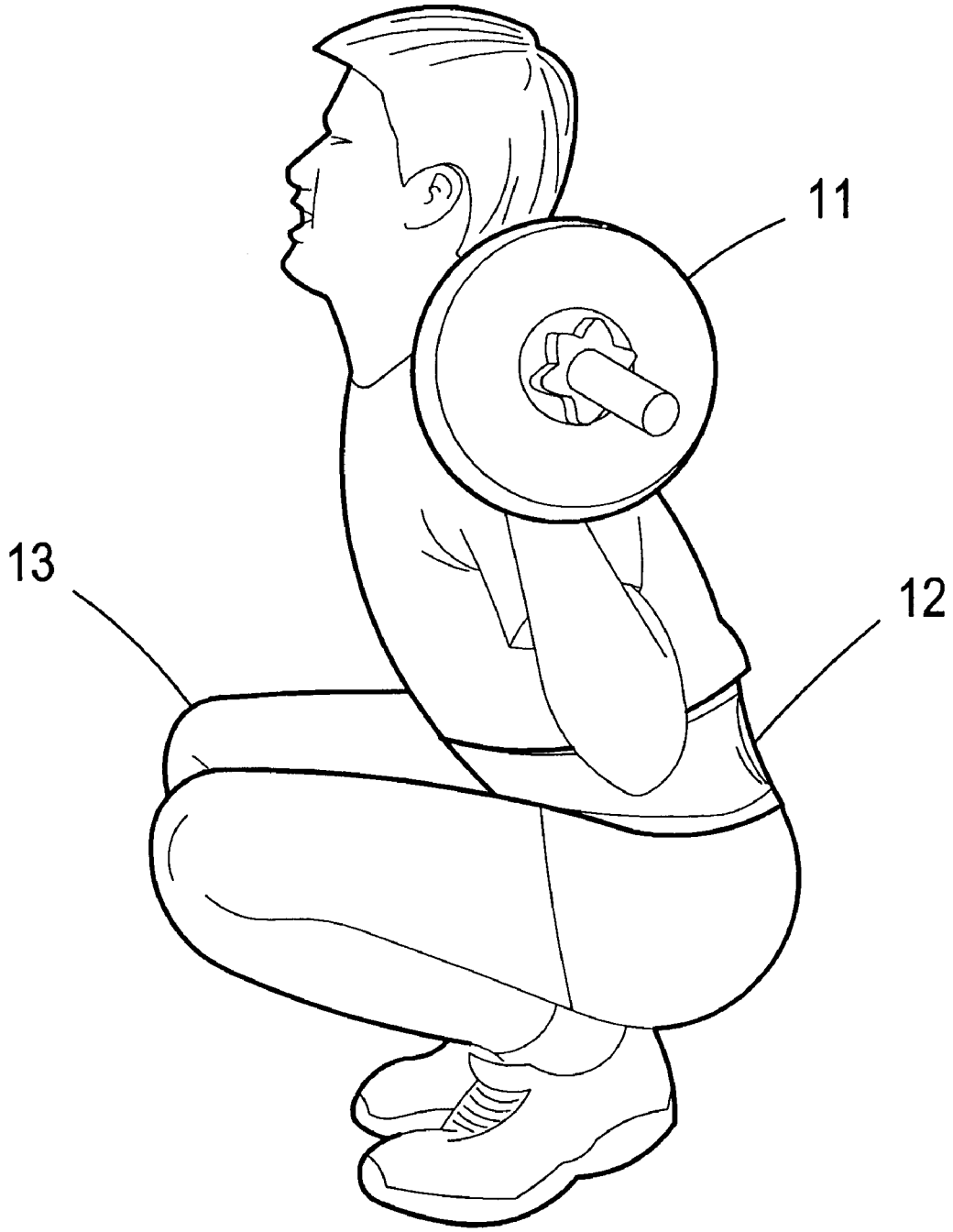
FIG. 1 is a schematic view showing the weight training on legs with a barbell in an earlier manner.
Figure 2:
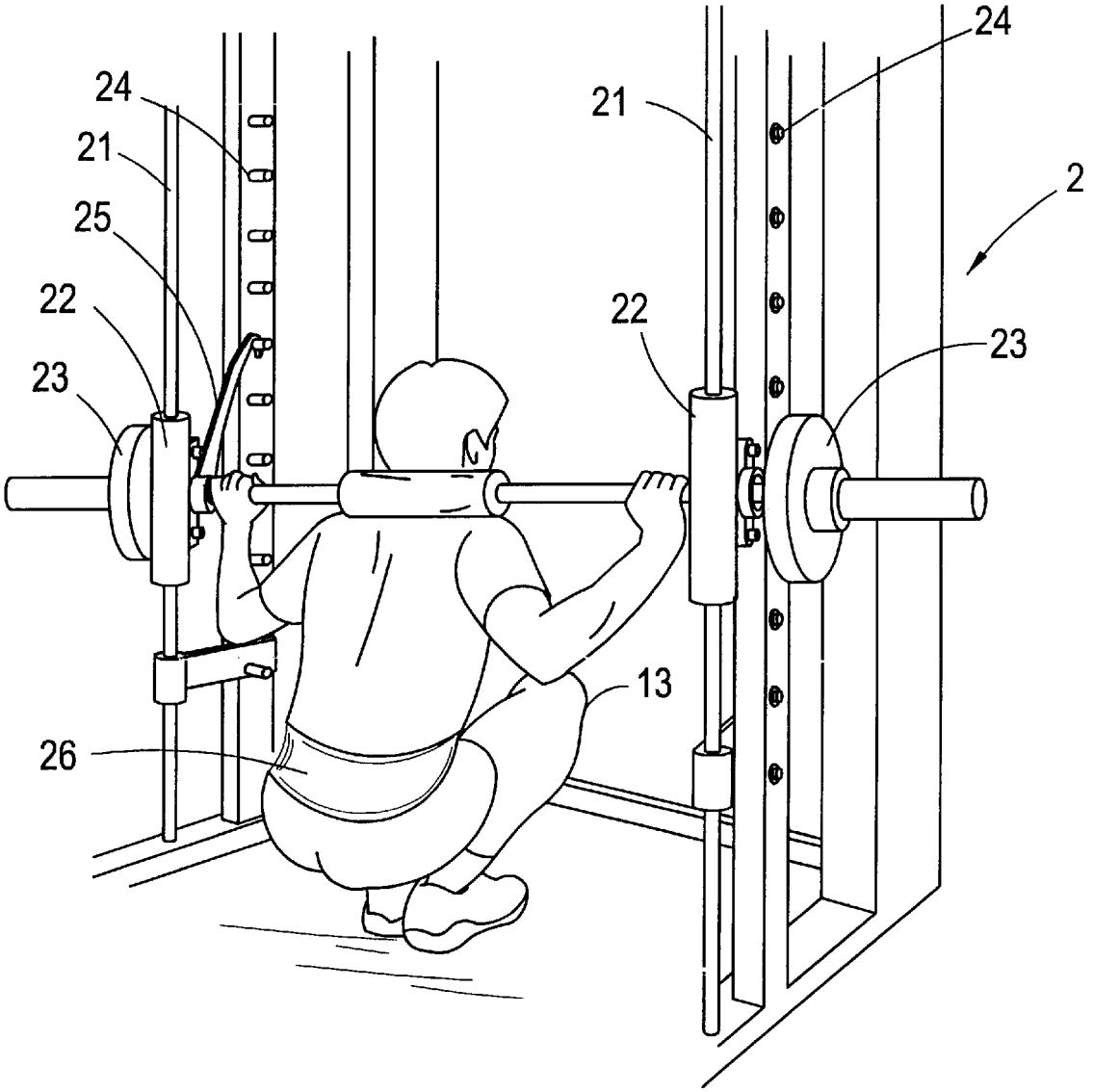
FIG. 2 is a three-dimensional view of a Smith's weight training gym.
Figure 3:
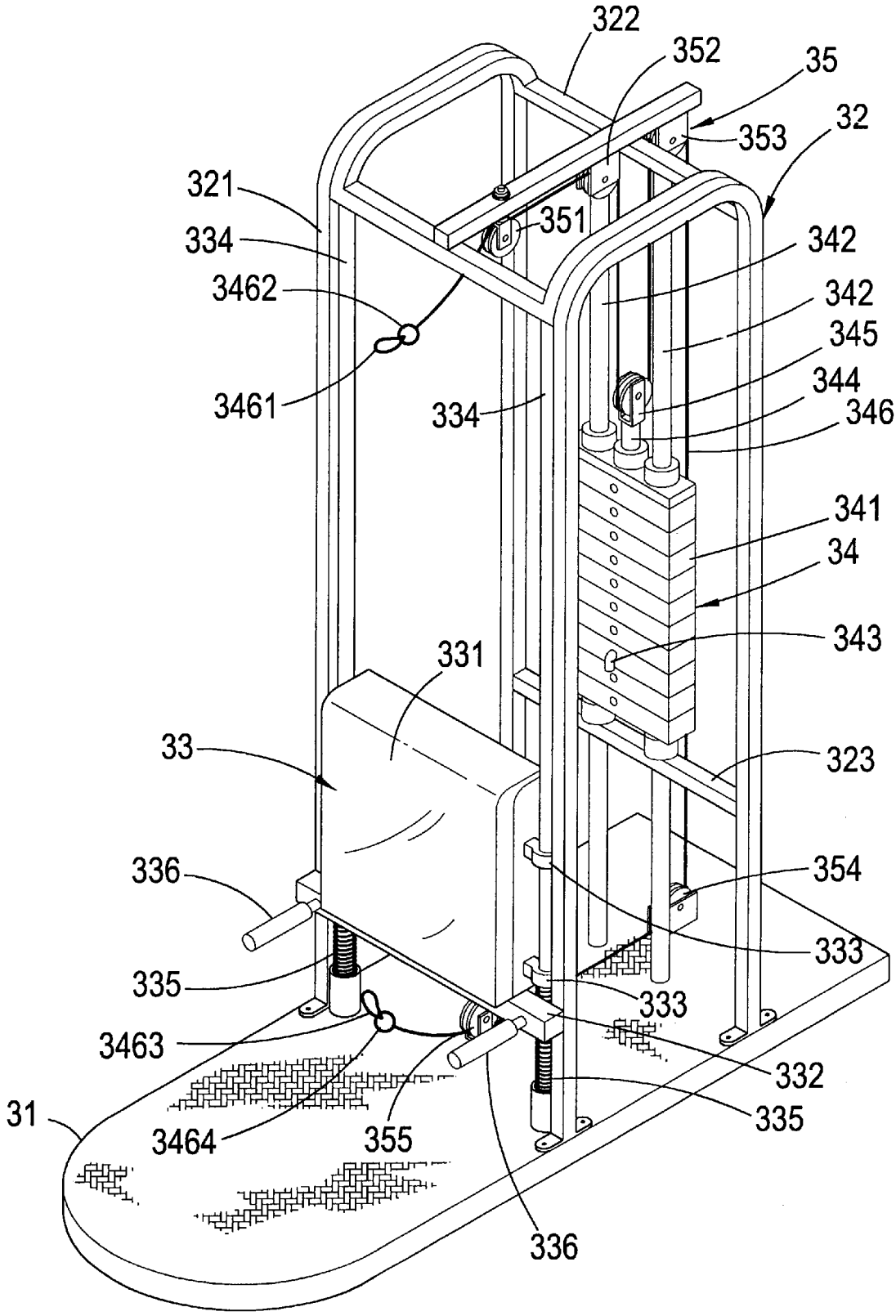
FIGS. 3A to 3I are three-dimensional schematic views of fittings for the full functional weight training gym according to the invention, including a two-handed long pulling bar, a two-handed short pulling bar, a single-handed short pulling bar, a single-handed ring-shaped pulling bar, a two-handed rope-type pulling bar, a leg band-type pulling ring, a back and forth adjustable plate chair, a foot pressing bar, and a quick snap loop.

Referring to FIG. 3, the fill functional weight training gym according to the invention comprises essentially: a supporting base 31, a main skeleton 32, a sliding backrest 33, a weights set 34, a pulley block 35 and a fitting set 36. Among them, said supporting base 31 is provided with a surface having protruding particulate thereon. Its front region is an area to be treaded upon by the user. Its rear region is provided thereon with all the constitutive supports. The main skeleton is consisted of two inverted U-shaped supports 321 that are provided oppositely on the rear region of the supporting base 31. Between these two supports 321, two crossbar parallel connecting rails 322 are provided oppositely to connect the two supports 321. All of the connecting parts of supports are assembled with nuts and bolts such that they can be detached and reassembled at any time, and that they act as the main supporting skeleton. The sliding backrest 33 is composed by providing a flexible back pad 331 on a frame 332 having parallel handles 336. Two pairs of bearings 333 on the opposite side of the frame 332 are hanged between two steel pipes 334 in a manner that the sliding backrest 33 can move straightly up and down between the two steel pipes 334. In addition, the sliding backrest 33 can have a foot pressing bar 368 provided on the rear surface thereof, as shown in FIG. 3H. Fixing with nuts and bolts is advantageous for assembling and detaching. The foot pressing bar 368 has a plurality of adjusting holes 3681 provided along its neck section. These adjusting holes 3681 are used to adjust flexibly the height of the foot pressing bar 368 as required so that users of different statures can use them in conjunction with the back and forth adjustable plate chair 367, as shown in FIG. 3G. the sliding backrest 33 is provided between the two front uprights of supports 321 of the main skeleton 32. Each bottom end of the two steel pipes 334 is slipped on a spring 335 to form a buffering region thereon against the falling of the sliding backrest 33. More springs can be provided in these buffering regions as required to increase the height of the buffering region. The weights set 34 is formed by hanging a plurality of weights 341 on two steel pipes 342. Pin bars 343 are used to select the number of weights 341 to be stacked together and are used to secure the set of weights formed therewith on the weights hanging bar 344. The weights set 34 thus formed is arranged at the central part of a lower crossbar 323 connected with the rear uprights of the two supports 321 of the main skeleton 32. With this arrangement, the weights 341 can move up and down, together with the running pulley 345 connected by the weights hanging bar 344, between two steel pipes 342. The pulley block 35 is consisted of six pulleys and one rope 346. The rope 346 passes over a upper semi-standing block 351 and then a upper front standing block 352, passes around a running block 345 connected with a weights hanging bar 344, goes back to a upper rear standing block 353, and passes directly over a lower semi-standing block 355 via a lower rear standing block 354 to pull out finally the rope 346. Each of both ends of the rope 346 is provided with a fastener consisting of a cord loop 3461, 3463 and a buffering bead 3462, 3464, respectively. These fasteners are provided between two crossbar parallel connecting rails 322 at the top of two supports 321 of the main skeleton 32 and the supporting base 31.

Figure 3D:
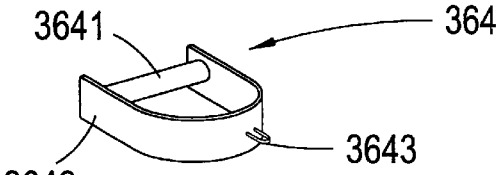
Figure 3E:
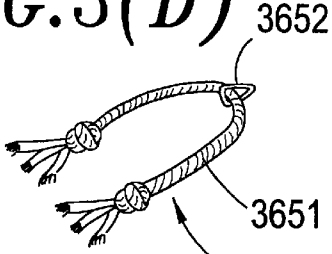
Figure 3F:
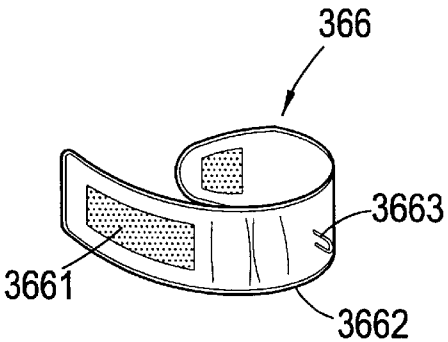
Figure 3A:
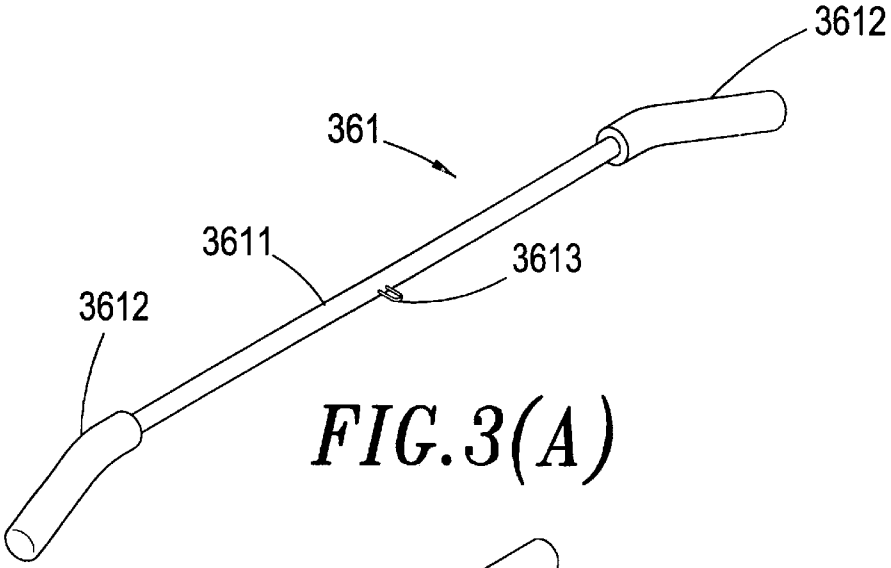
Figure 3B:
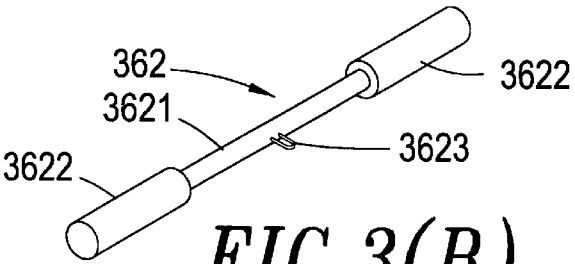
Figure 3C:
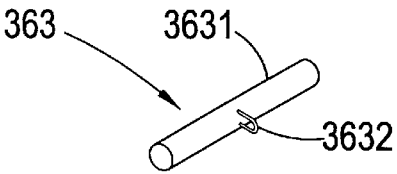
Figure 3I:
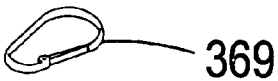
Figure 3H:
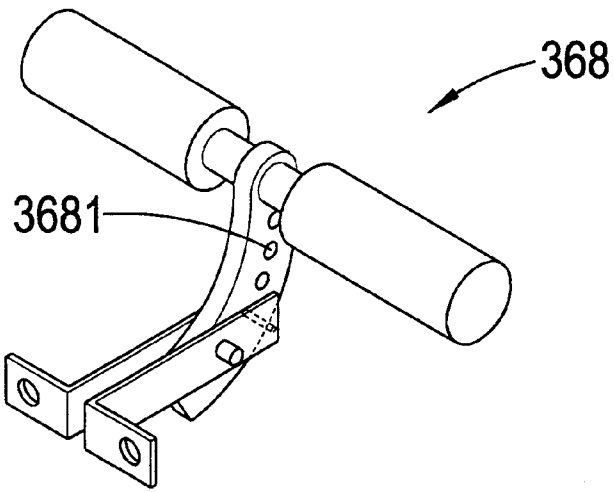
Figure 3G:
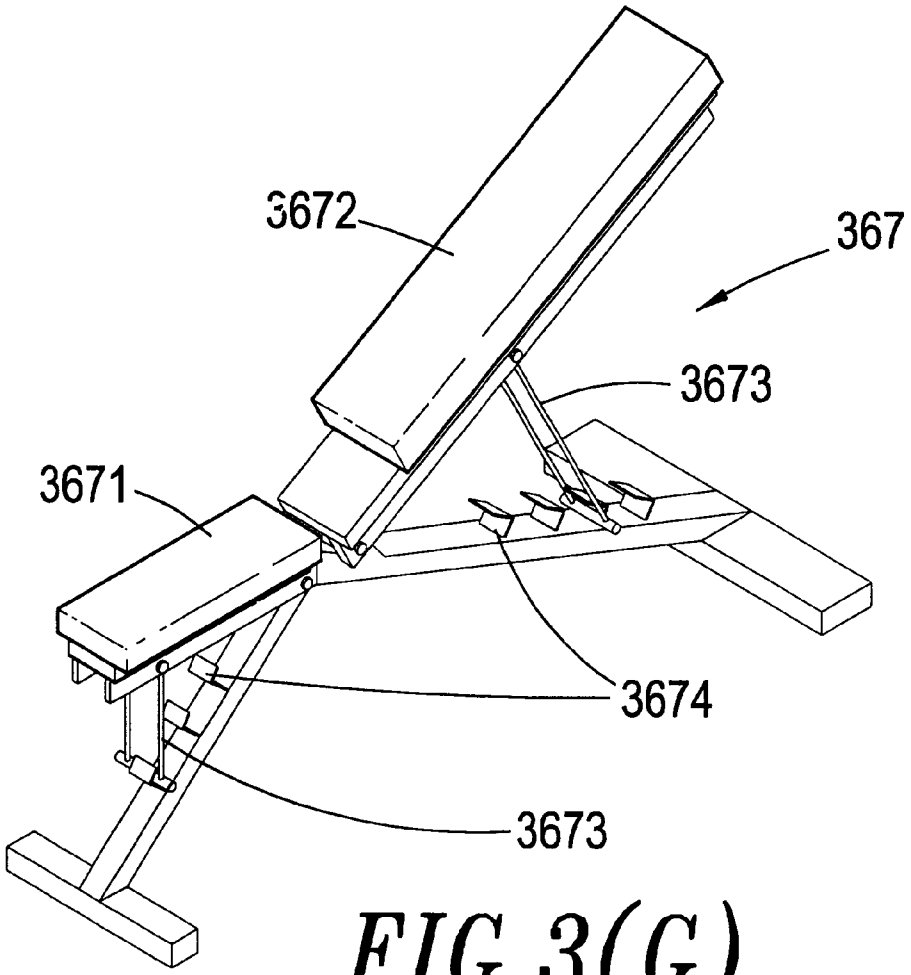

The fittings set 36, referring to FIGS. 3A to 3I, comprises a two-handed long pulling bar 361, a two-handed short pulling bar 362, a single-handed short pulling bar 363, a single-handed ring-shaped pulling bar 364, a two-handed rope-type pulling bar 365, a leg band-type pulling ring 366, a back and forth adjustable plate chair 367, a foot pressing bar 368, and a quick snap loop 369. The two-handed long pulling bar 361, shown in FIG. 3A, is made from a long steel pipe 3611 whose both ends bend slightly and are slipped on with handle grip sleeves 3612. A rope cord loop 3613 is provided at the center of the steel pipe and is parallel to the steel pipe in a manner that it can be snapped and hanged with the upper and lower cord loops 3461, 3463 via a quick snap loop 369. The two-handed short pulling bar 362, shown in FIG. 3B, is made from a straight short steel pipe 3621 having a handle grip sleeve 3622 provided on each of both ends thereof. A rope cord loop 3623 is provided at the center of the steel pipe and is parallel or perpendicular to the steel pipe in a manner that it can be snapped and hanged with the upper and lower cord loops 3461, 3463 via a quick snap loop 369. The single-handed short pulling bar 363, shown in FIG. 3C, is made from a straight and short steel pipe 3631. A rope cord loop 3632 is provided at the center of the steel pipe and is perpendicular to the steel pipe in a manner that it can be snapped and hanged with the upper and lower cord loops 3461, 3463 via a quick snap loop 369. FIG. 3D shows the single-handed ring-shaped pulling bar 364. It is made by snapping a steel pipe 3641 onto a U-shaped ring 3642 to form a removable handle grip. A rope cord loop 3643 is provided at the center of semi-circular arc of the U-shaped ring in a manner that it can be snapped and hanged with the upper and lower cord loops 3461, 3463 via a quick snap loop 369. FIG 3E shows the two-handed rope-type pulling bar 365. It is made by hitching a rope cord loop 3652 on a coarse rope 3651 in a manner that it can be snapped and hanged with the upper and lower cord loops 3461, 3463 via a quick snap loop 369. The leg band-type pulling ring 366, as shown in FIG. 3F, is a cloth band made by combining a Velcro tape 3661 and a cloth 3662. A rope cord loop 3663 is provided at the center of the cloth band in a manner that it can be snapped and hanged with the upper and lower cord loops 3461, 3463 via a quick snap loop 369. FIG. 3G shows the back and forth adjustable plate chair 367. It comprises essentially two sections of adjustable plate chairs. Two T-shaped included angle supports 3673 extend in both included angles between the front section plate chair 3671 and the rear section plate chair 3672. A plurality of adjusting steps 3674 are provided on lower movable supports extending downwardly from the front section plate chair 3671 and the rear section plate chair 3672 to support these plate chairs by mounting those T-shaped included angle supports 3673 on these steps 3674.

Figure 4:
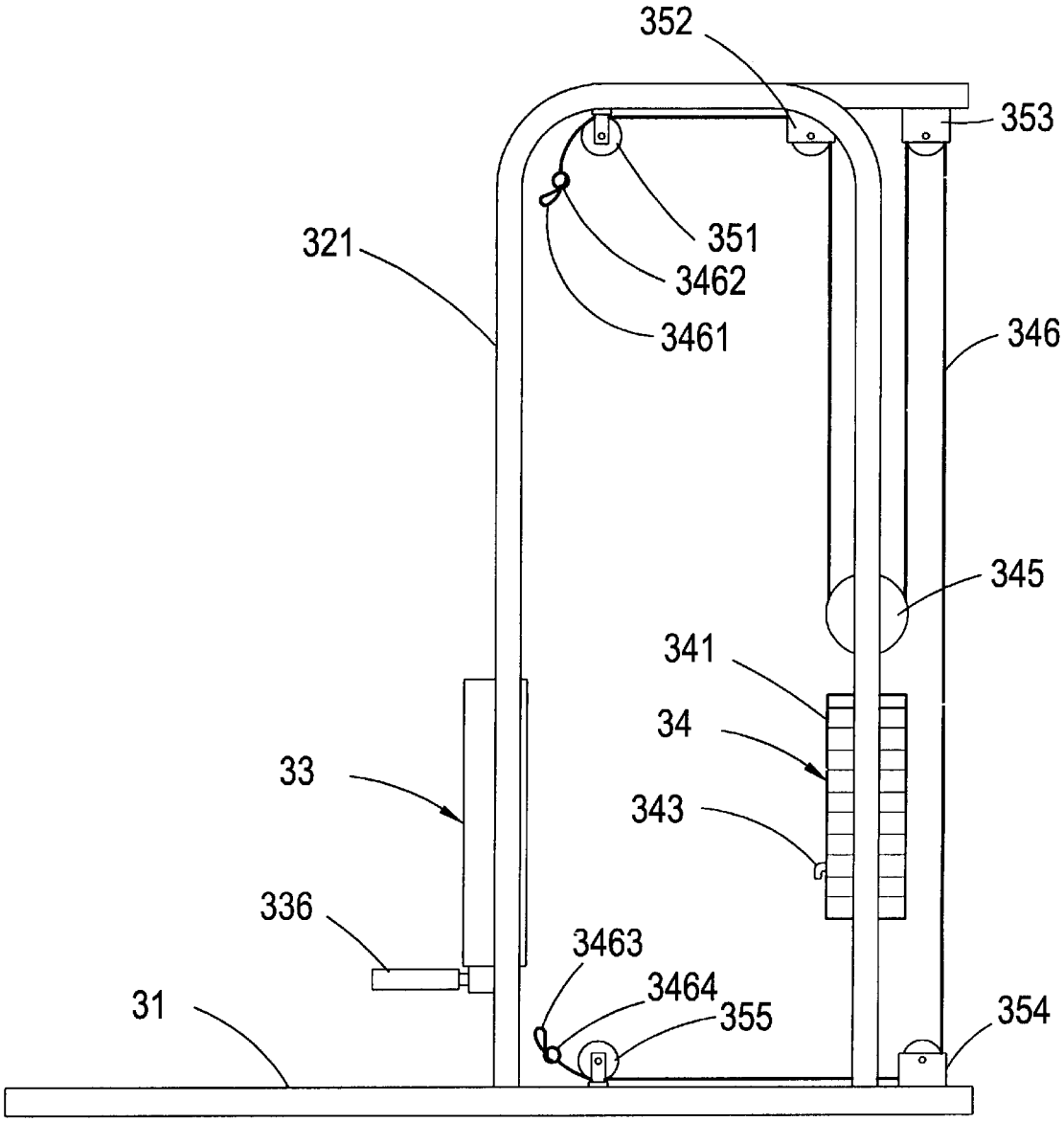
FIG. 4 is the side view of the full functional weight training gym.
Figure 4B:
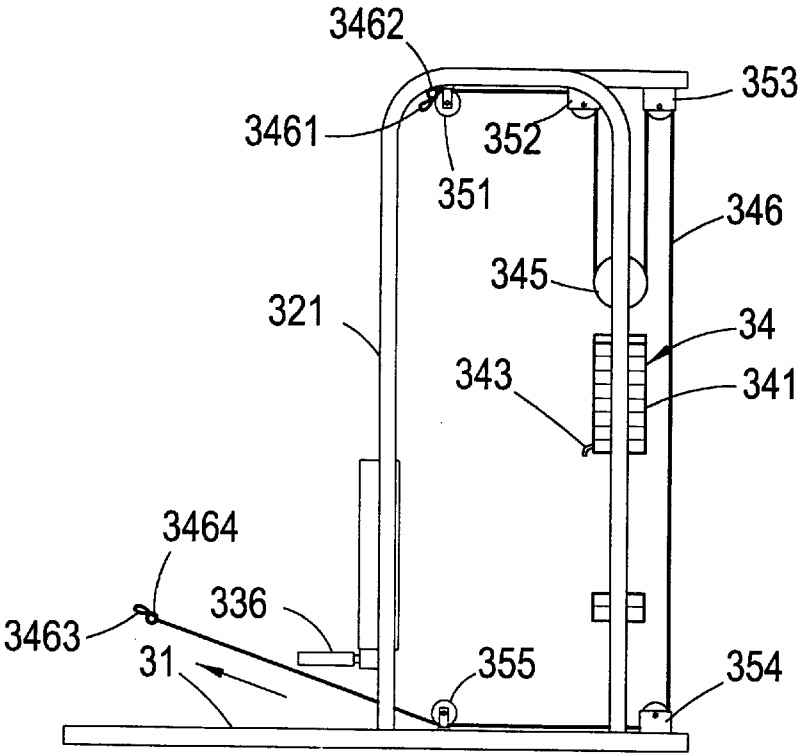
FIGS. 4A and 4B is a schematic view showing the operation of the full functional weight training gym according to the invention.
Figure 4A:
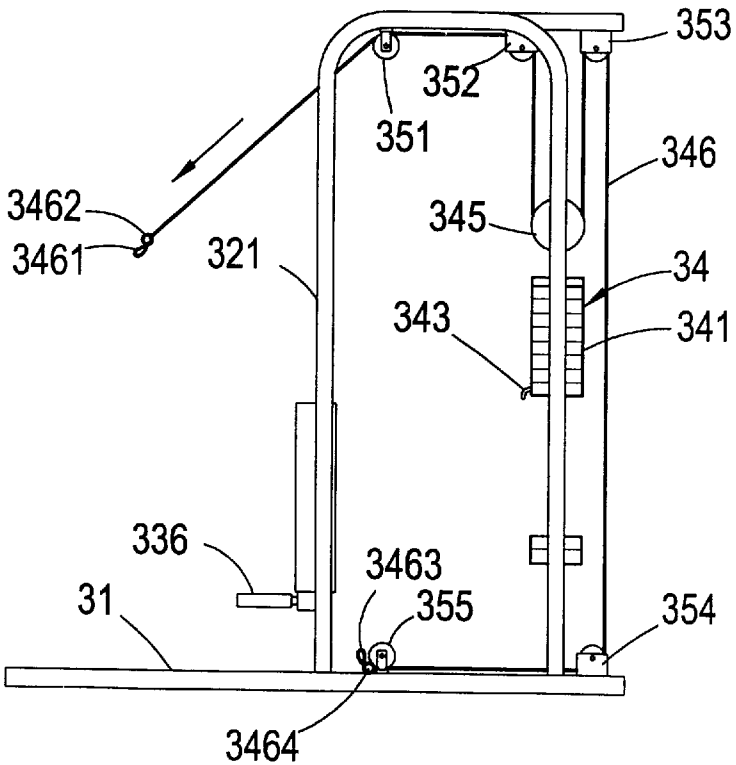

Referring to FIGS. 4, 4A and 4B, a view of the state not used, a side view and a operation view, of the full functional weight training gym according to the invention are shown, respectively. As shown in FIG. 4, the cord loops 3461, 3463 and buffering beads 3462, 3464 on the rope 346 are positioned at the ends of the upper semi-standing block 351 and lower semi-standing block 355, respectively, in a manner of providing use by combining with any fittings 36 at any time; while, the pin bar 343 of the weights set 34 can be adjusted according to the weight selected during the training. FIG. 4A shows the action state when the upper cord loop 3461 on the rope 346 is pulled downwardly, where the buffering bead 3464 of the lower cord loop 3463 on the rope 346 is fixed by the lower semi-standing block 355. Under this circumstance, the weights set 34 will be polled up by the sliding of the upper semi-standing block 351 and the upper front standing block 352. Further, in FIG. 4B, a action state of the weights set 34 as it is pulled upwardly by the cord loop 3463 on the rope 346 is shown, where the buffering bead 3462 of the upper cord loop 3461 on the rope 346 is fixed by the upper semi-standing block 351. As a result, the weights set 34 is pulled upwardly by the sliding of the lower rear standing block 354 and the upper rear standing block 353.

Figure 5:
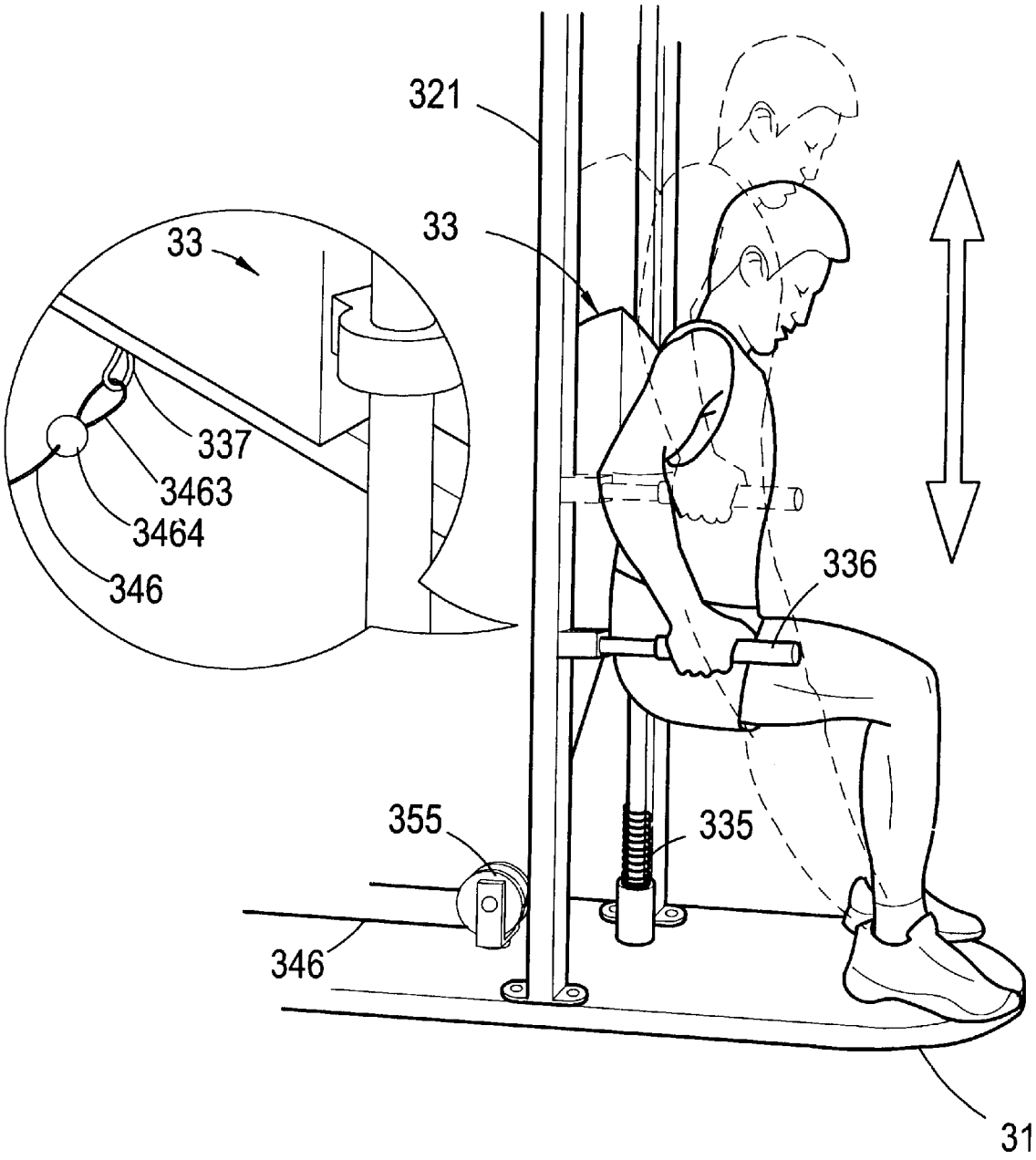
FIG. 5 is a schematic view showing an example of training on leg with the full functional weight training gym according to the invention.

Now, referring to FIG. 5, a practical example of training on legs is shown schematically. As the user is in a standing pose and the sliding backrest 33 is pulled upwardly, the lower cord loop 3463 on the rope must be snapped on the cord loop 337 on the bottom of the sliding backrest 33 to connect the pulley block 35, the weights set 34 and the sliding backrest 33. When training, the user stands into the front area, grips securely the handle 336 with both hands, pulls up the sliding backrest 33 by leaning his back tightly against the sliding backrest 33, and stands up to allow an inclined angle to be formed from the waist to the feet (as shown by the dashed line). Then, the sliding backrest 33 is allowed to slide downwardly step by step till the leg forms a sitting pose of an angle of 90 degree. With this manner of sliding up and down, the training on muscles of legs and feet can be achieved. In the course of this training, the user needs not to tie up a waistband and can operate safely without hurting the waist and the spinal cord. By aid of the full functional weight training gym according to the invention, the user can carry out weight training on legs in right pose at home without safety concern. Furthermore, by means of this full functional weight training gym, pulling muscles on one leg in a kneel pose, muscle training on feet by standing on toes, or leg training by squatting and standing through pulling and lifting the sliding backrest 33 with both hands as faces the sliding backrest 33, can be carried out to achieve the training on muscles of legs.

The full functional weight training gym according to the invention has following advantages over the conventional techniques:

1. By sliding the sliding backrest, a right pose of the user during weight training on legs can be adapted naturally and the purpose of leg training can be achieved safely without using a waistband.

2. During weight training on legs, once the user can not tolerate the load, he can drop down the handle of the sliding backrest instantly to let the sliding backrest slide down without hurting the body; this reveals the somewhat safeness of the full functional weight training gym according to the invention.

3. In addition to the main training on legs, by combining other accessory fittings, training on other parts of the body including hands, the chest, the abdominal, the waist, the bottom, the back and shoulders can be done as well.

4. By providing common users only one gym and a less space, the purpose of full functional bodybuilding can be achieved.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A full functional weight training gym according to the invention comprises essentially:

a supporting base, provided with a surface having protruding particulate thereon;

a main skeleton, consisting of two inverted U-shaped supports that are provided oppositely on the rear region of the supporting base; and two crossbar parallel connecting rails provided oppositely between these two ⊓shaped supports to connect said two ⊓shaped supports;

a sliding backrest, composed by providing a flexible back pad on a frame having parallel handles; two pairs of bearings, hanged between two steel pipes on the opposite side of said frame in a manner that the sliding backrest can move straightly up and down between the two steel pipes; wherein said sliding backrest is provided between two front uprights of said supports of the main skeleton; and a spring is slipped on each bottom end of said two steel pipes to form a buffering region thereon against the falling of the sliding backrest;

a weights set, formed by hanging a plurality of weights on two steel pipes; wherein pin bars are used to select the number of weights to be stacked together and to secure the set of weights formed therewith on a weights hanging bar; wherein said weights set thus formed is arranged at the central part of a lower crossbar connected with two rear uprights of said two supports of said main skeleton; wherein, said weights can move up and down between said two steel pipes together with a running pulley connected by a weights hanging bar;

a pulley block, consisted of six pulleys and one rope; wherein said rope passes over a upper semi-standing block and then a upper front standing block, passes around a running block connected with a weights hanging bar, goes back to a upper rear standing block, and passes directly over a lower semi-standing block via a lower rear standing block to pull out finally the rope; wherein each of both ends of the rope is provided with a fastener consisting of a cord loop and a buffering bead, respectively; and these fasteners are provided between two crossbar parallel connecting rails at the top of said two supports of said main skeleton and the supporting base; and a fitting set, comprising a two-handed long pulling bar, a two-handed short pulling bar, a single-handed short pulling bar, a single-handed ring-shaped pulling bar, a two-handed rope-type pulling bar, a leg band-type pulling ring, a back and forth adjustable plate chair, a foot pressing bar, and a quick snap loop; wherein, by snapping and hanging said pulling bars and said pulling rings with cord loop on both ends of said rope via said quick snap loop, a gym that is capable of carrying out weight training on various parts of the body can be constructed; and particularly, a gym that is capable of carrying out weight training on various parts of the body can be constructed on the base of said base by assembling said main skeleton with nuts and bolts; and snapping and hanging the sliding backrest by said rope to connect and move said pulley block and said weights set up and down.

2. A full functional weight training gym as cited in claim 1, wherein said supports of said main skeleton are combined by nuts and bolts.

3. A full functional weight training gym as cited in claim 1, wherein said springs provided on each bottom end of said two steel pipes of said sliding backrest can be increased as required to increase the height of the buffering region.

4. A full functional weight training gym as cited in claim 1, wherein said two-handed long pulling bar in said fittings set is made from a long steel pipe whose both ends bend slightly and are slipped on with handle grip sleeves; and wherein a rope cord loop is provided at the center of said steel pipe and is parallel to said steel pipe.

5. A full functional weight training gym as cited in claim 1, wherein said two-handed short pulling bar in said fittings set is made from a straight short steel pipe having a handle grip sleeve provided on each of both ends thereof and wherein a rope cord loop is provided at the center of said steel pipe and is parallel or perpendicular to said steel pipe.

6. A full functional weight training gym as cited in claim 1, wherein said single-handed short pulling bar in said fittings set is made from a straight and short steel pipe; and wherein a rope cord loop is provided and is perpendicular to said steel pipe.

7. A full functional weight training gym as cited in claim 1, wherein said single-handed ring-shaped pulling bar in said fittings set is made by snapping a steel pipe onto a U-shaped ring to form a removable handle grip; and wherein a rope cord loop is provided at the center of semi-circular arc of said U-shaped ring.

8. A full functional weight training gym as cited in claim 1, wherein said two-handed rope-type pulling bar in said fittings set is made by hitching a rope cord loop on a coarse rope.

9. A full functional weight training gym as cited in claim 1, wherein said leg band-type pulling ring in said fittings set is a cloth band made by seaming a Velcro tape and a cloth together.

10. A fill functional weight training gym as cited in claim 1, wherein said back and forth adjustable plate chair in said fittings set comprises two sections of adjustable plate chairs; wherein two T-shaped included angle supports extend in both included angles between the front section plate chair and the rear section plate chair and wherein a plurality of adjusting steps are provided on lower movable supports extending downwardly from the front section plate chair and the rear section plate chair to support these plate chairs by mounting those T-shaped included angle supports on these steps.

11. A full functional weight training gym as cited in claim 1, wherein said foot pressing bar in said fittings set is fixed on a frame at the rear surface of said sliding backrest; wherein said foot pressing bar has a plurality of adjusting holes provided along its neck section; and wherein said adjusting holes are used to adjust flexibly the height of the foot pressing bar as required.

12. A full functional weight training gym as cited in claim 1, wherein said quick snap loop is a ring-shaped snap loop made of iron material and wherein a flexible press bar-type switch is provided at the opening to form a notch once being pressed at any time and to restore the ring shape as being released.

* * * * *